US005834887A

United States Patent [19]

Spanjer et al.

[11] Patent Number: 5,834,887

[45] Date of Patent: Nov. 10, 1998

[54] COLOR CATHODE RAY TUBE COMPRISING AN IN-LINE ELECTRON GUN WITH EXTENDED OUTER APERTURES

[75] Inventors: Tjerk G. Spanjer; Lambert J. Stil; Johannes H. Bohlander; Abraham A. Los; Antonius J Pennings, all of Eindhoven, Netherlands

[73] Assignee: U.S. Philips Corporation, New York, N.Y.

[21] Appl. No.: 593,994

[22] Filed: Jan. 30, 1996

[30] Foreign Application Priority Data

Feb. 14, 1995 [EP] European Pat. Off. ..... 95200346

[51] Int. Cl.[6] ..... H01J 29/56

[52] U.S. Cl. ..... 313/412; 313/414; 313/432; 313/439

[58] Field of Search ..... 313/414, 412, 313/446, 413, 432, 439

[56] References Cited

U.S. PATENT DOCUMENTS

| | | | |
|---|---|---|---|
| 4,626,738 | 12/1986 | Gerlach | 313/414 |
| 5,146,133 | 9/1992 | Shirai et al. | 313/414 |
| 5,592,046 | 1/1997 | Kim | 313/414 |

*Primary Examiner*—Sandra L. O'Shea
*Assistant Examiner*—Joseph Williams
*Attorney, Agent, or Firm*—John C. Fox

[57] ABSTRACT

An in-line electron gun includes main lens electrodes, a common aperture and, at a distance from the common aperture, three in-line apertures in a plate-shaped part. The outer apertures extend, viewed in a direction transverse to the plate-shaped part, beyond the common aperture.

9 Claims, 3 Drawing Sheets

COLOR CATHODE RAY TUBE COMPRISING AN IN-LINE ELECTRON GUN WITH EXTENDED OUTER APERTURES

BACKGROUND OF THE INVENTION

The invention relates to a colour cathode ray tube comprising an in-line electron gun for generating three coplanar electron beams, said electron gun having a main lens portion comprising a first lens electrode and a second lens electrode, said first and second lens electrodes each having an aperture which is common to the three electron beams and which is bounded by an edge, and said lens electrodes each having a central aperture and two outer apertures for allowing passage of, respectively, the central and outer electron beams, said central and outer apertures being situated in a plate-shaped part which is arranged in the relevant lens electrode at some distance from and recessed with respect to the common aperture, said common apertures of the first and second lens electrodes facing each other. Such colour cathode ray tubes are used, inter alia, in television receivers and computer monitors.

A colour cathode ray tube of the type mentioned in the opening paragraph is known from U.S. Pat. No. 4,626,738.

Said document describes a colour cathode ray tube comprising an in-line electron gun. Said in-line electron gun (in-line electron gun is the customary designation for a means for generating three electron beams extending in one plane, the so-called in-line plane) comprises a main lens. Said main lens has two lens electrodes. Each lens electrode has a common aperture (in U.S. Pat. No. 4,626,738 this aperture is formed by a folded edge) and a plate-shaped part which is recessed relative to the common aperture (termed "recessed part" in U.S. Pat. No. 4,626,378) and which has three in-line apertures.

An improvement of the picture quality is aimed at.

OBJECTS AND SUMMARY OF THE INVENTION

It is an object of the invention to provide a colour cathode ray tube of the type mentioned in the opening paragraph, which demonstrates an improved picture quality. To this end, a colour cathode ray tube in accordance with the invention is characterized in that of at least one of the lens electrodes, the outer apertures in the plate-shaped part are formed such that, viewed in projection on the plate-shaped part and from the other lens electrode, the outer apertures extend in the in-line plane beyond the edge of the common aperture, said outer apertures being entirely enclosed in said plate-shaped part.

By virtue thereof, the effective lens diameter for the outer apertures can be increased and hence the quality of the main lens improved, which leads to an improved picture quality. The outer apertures are entirely enclosed in the plate-shaped part, this means in particular that the outer apertures are always separated from the inside of the tubular part by an edge of said plate-shaped part. By virtue thereof, the position of the outer apertures relative to the common aperture and relative to each other can be accurately defined and reproduced in a simple manner.

The first lens electrode and the second lens electrode preferably comprise identical parts. This leads to an improved reproducibility of the quality of the main lens.

In an embodiment, the distance between the folded edge and the plate-shaped part is different for the first lens electrode and the second lens electrode. By virtue thereof, both the so-called core haze asymmetry (CHA) and the beam displacement can be kept down.

In another embodiment, the distance between the common aperture and the plate-shaped part is equal for both lens electrodes. This results in a reduction of manufacturing differences between lens electrodes and hence in an improved reproducibility of the quality of the main lens.

In a further embodiment, the ratio of the distance between the common aperture and the plate-shaped part to the distance over which the outer apertures in the plate-shaped part extend beyond the edge of the common aperture ranges between 0.5 and 5. The favourable effect is obtained by cooperation between the common aperture and the enlarged apertures. If the distance between the common aperture and the plate-shaped part is too small (ratio smaller than 0.5) or too large (ratio greater than 5) the effect of this cooperation is Preferably, the outer apertures are separated from an inner wall of the relevant lens electrode, at least, by an edge of approximately 0.3 mm of the plate-shaped part. Edges thinner than approximately 0.3 mm can deform relatively easily in the manufacture of the plate-shaped part or during securing the plate-shaped part in the lens electrode. This adversely affects the quality of the main lens.

The distance over which the outer apertures in the plate-shaped part extend beyond the edge of the common aperture, preferably, is at least 5% of the dimension of the outer apertures, measured in the in-line plane.

These and other aspects of the invention will be apparent from and elucidated with reference to the embodiments described hereinafter.

BRIEF DESCRIPTION OF THE DRAWINGS

In the drawings.

The Figures are not drawn to scale. In general, like reference numerals refer to like parts.

DESCRIPTION OF THE PREFERRED EMBODIMENTS

Figure 1:
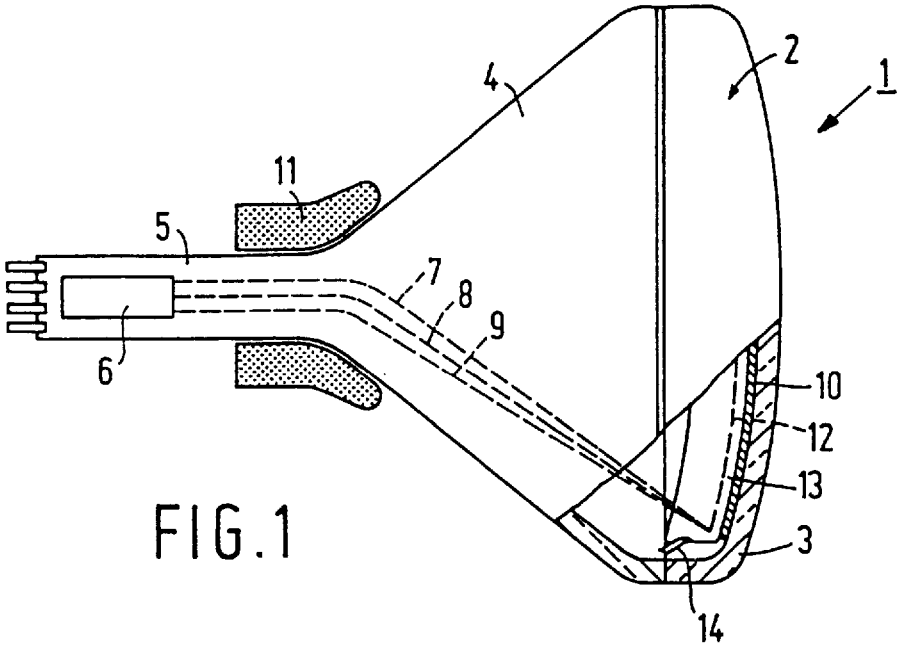
FIG. 1 is a sectional view of a colour cathode ray tube.

A colour cathode ray tube 1 comprises an evacuated envelope 2 which, in this example, is composed of a display window 3, a cone portion 4 and a neck 5. In the neck there is provided an in-line electron gun 6 for generating three electron beams 7, 8 and 9 which extend in one plane, the in-line plane, which in this case is the plane of the drawing. A display screen 10 is situated on the inside of the display window 3. Said display screen 10 comprises a large number of picture elements luminescing in red, green and blue. On their way to the display screen, the electron beams are deflected across the display screen 10 by means of an electromagnetic deflection unit 11 and pass through a colour selection electrode 12 (such a colour selection electrode is sometimes alternatively referred to as shadow mask) which is arranged in front of the display window 3 and which comprises a thin plate having apertures 13. Said colour selection electrode is suspended in the display window 3 by means of suspension elements 14. The electron beams 7, 8 and 9 pass through the apertures 13 of the colour selection electrode at a small angle with respect to each other and, consequently, each electron beam impinges on phosphor elements of only one colour.

Figure 2:
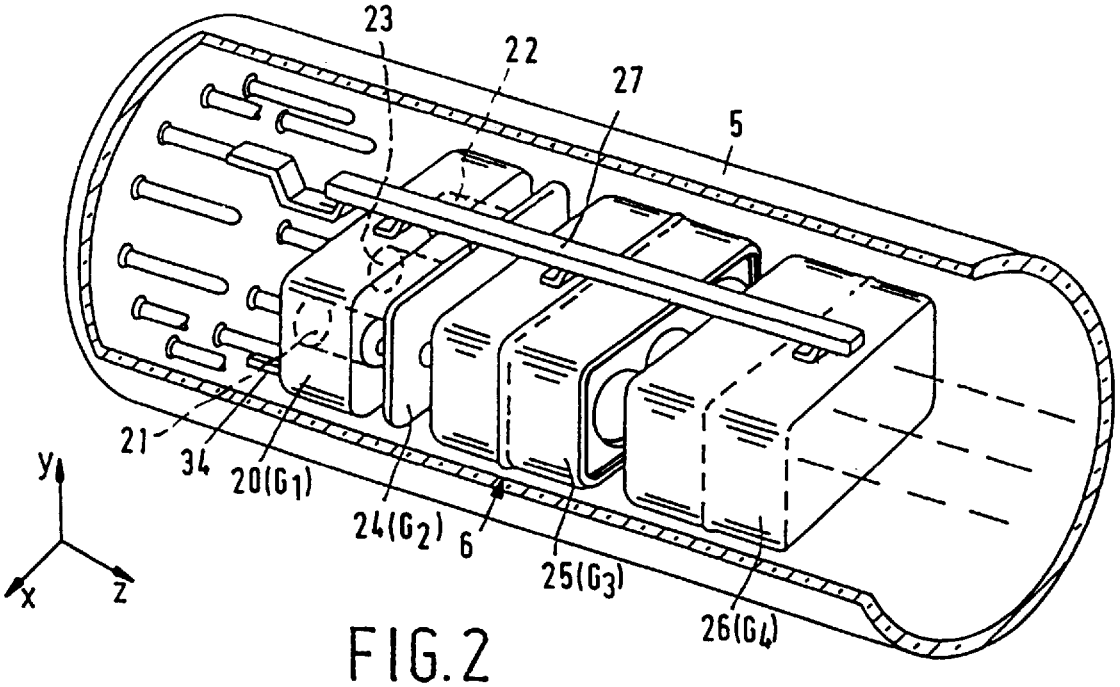
FIG. 2 is a sectional view of an electron gun.

FIG. 2 shows, by way of example, an in-line electron gun 6 in section. Said electron gun comprises three cathodes 21, 22 and 23. The electron gun further comprises a first common electrode 20 ($G_1$), a second common electrode 24 ($G_2$), a third common electrode 25 ($G_3$) and a fourth common electrode 26 ($G_4$). Said electrodes have connections for applying voltages to the electrodes. The colour cathode ray tube has leads, not shown, for applying voltages to the electrodes. By applying voltages, electric fields are generated between the electrodes. In this example, the main lens is formed between the $G_3$ and $G_4$ electrodes. The electrodes are interconnected by means of connecting elements, in this example glass rods 27, which are supported by brackets 34.

Figure 3A:
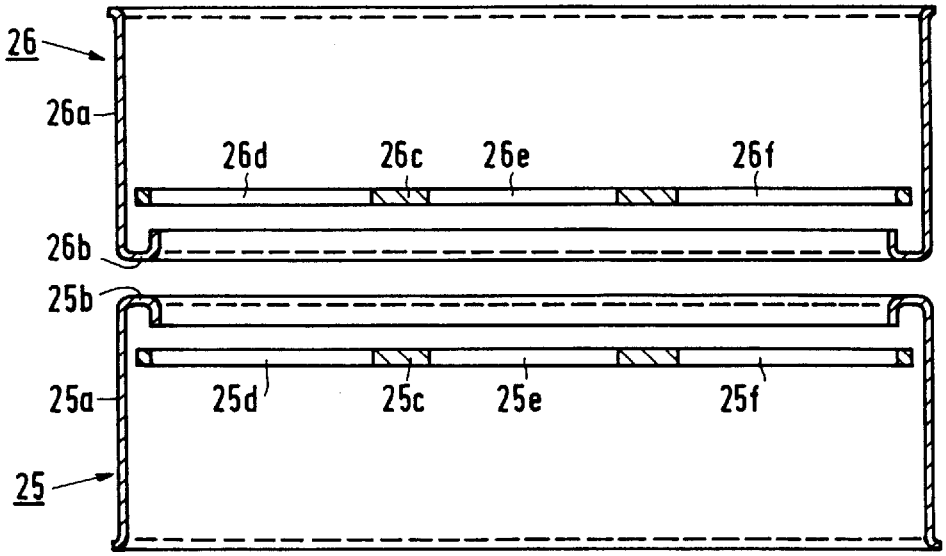
FIGS. 3A, 3B and 3C are, respectively, a sectional view, plan view and perspective view of a detail of an electron gun.

FIG. 3A is a sectional view, along the in-line plane, of a detail of the electron gun shown in FIG. 2. In particular the electrodes 25 ($G_3$) and 26 ($G_4$) are shown. Both electrodes comprise a tubular part 25*a* and 26*a*, respectively, which is provided with a folded edge 25*b* and 26*b*, respectively, and a plate-shaped part 25*c* and 26*c*, respectively. The plate-shaped parts are each provided with three apertures (25*d*, 25*e*, 25*f* and 26d, 26*e* and 26*f*, respectively). The folded edge forms the edge of a common aperture for the three electron beams. The outer apertures 25*d*, 25*f*, 26*d*, 26*f* are formed so that they extend beyond the edge 25*b*, i.e. the outer apertures extend, viewed through the common aperture transverse to the plate-shaped part, on both sides beyond the common aperture. Preferably, the common aperture is formed by a folded edge, as shown in FIG. 3A. The common aperture can alternatively be formed in a flat plate.

Figure 3B:
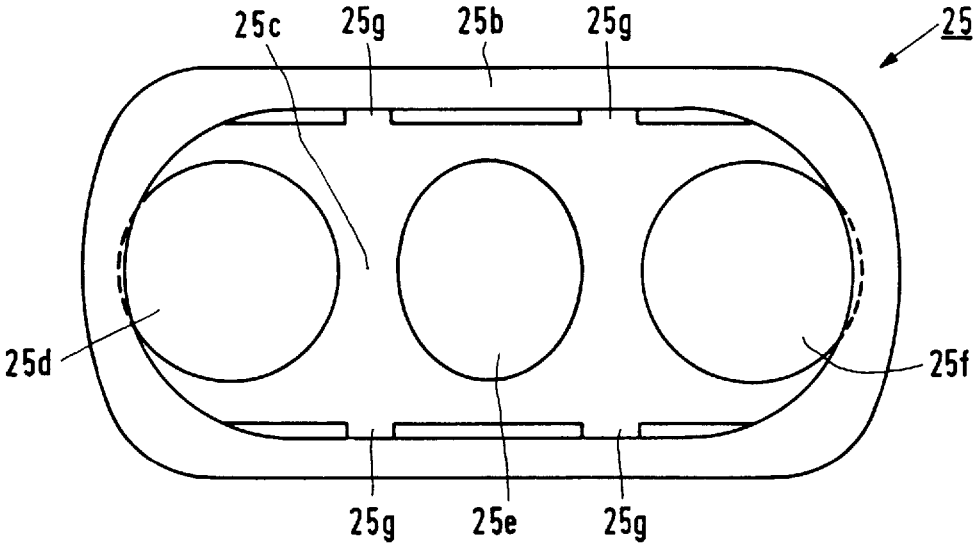

FIG. 3B is a plan view of electrode 25, i.e. in projection on the plate-shaped part and from electrode 26. The parts of the outer apertures 25*d* and 25*f* which are situated below the edge are indicated in FIG. 3B by means of dotted lines. It is clearly visible that the outer apertures extend beyond the common aperture.

Figure 3C:
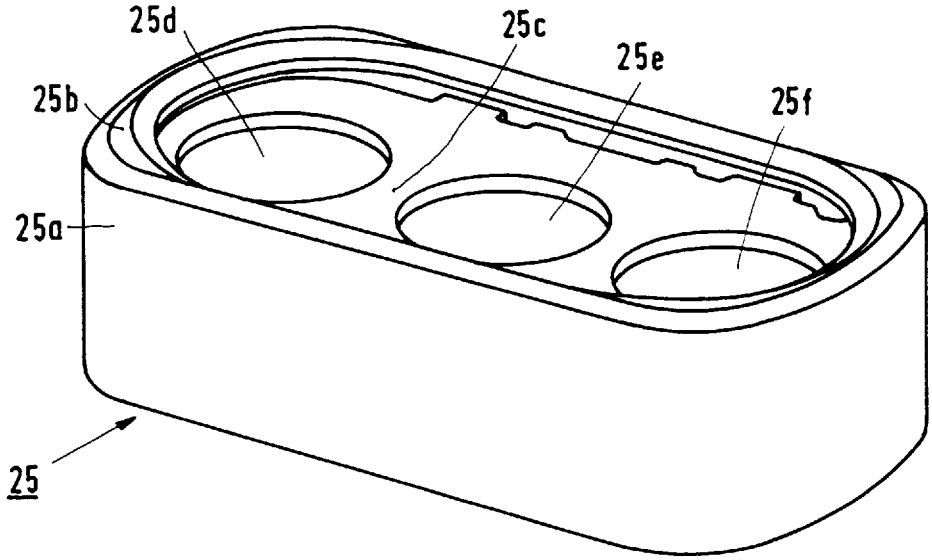

FIG. 3C is a perspective view of electrode 25.

Figure 4:
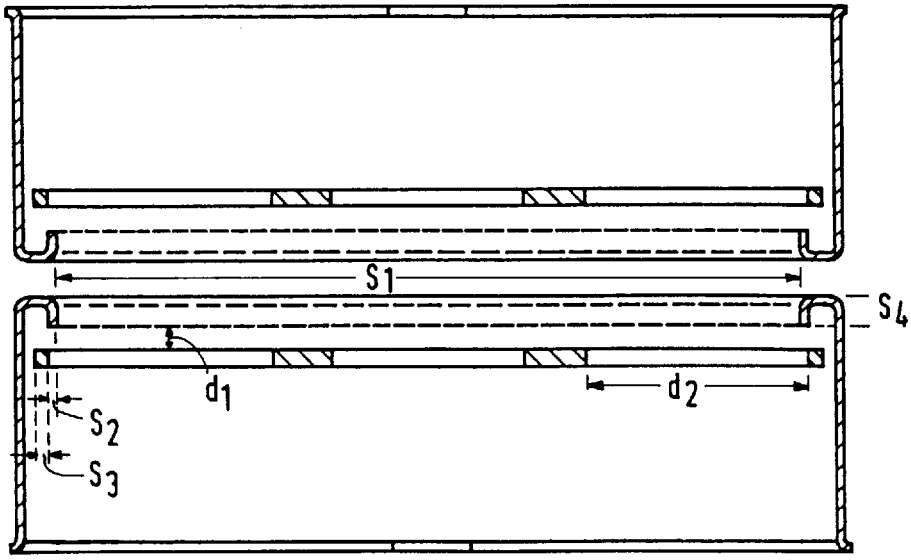
FIG. 4 is derived from FIG. 3A, but it is provided with some size indications.

FIG. 4 shows the same as FIG. 3A, with this difference that it provides a number of size indications. In said Figure, there is indicated, more particularly, the distance between the folded edge and the plate-shaped part ($d_1$), the dimension of the folded edge in the in-line plane ($s_1$), the diameter of the outer apertures in the in-line plane ($d_2$), the distance over which the outer apertures extend beyond the folded edge ($s_2$), the dimension of the edge of the plate-shaped part between the outer apertures and the tubular part ($s_3$) and the height of the edge ($s_4$).

In a preferred embodiment, the ratio of the distance between the common aperture and the plate-shaped part ($d_1$) to the distance over which the outer apertures in the plate-shaped part extend beyond the folded edge ($s_2$) ranges between 0.5 and 5, i.e. $0.5 \leqq d_1/s_2 \leqq 5$. The favourable effect is achieved by cooperation between the common aperture and the enlarged outer apertures. If the distance between the common aperture and the plate-shaped part is too small (ratio below 0.5) or too large (ratio above 5), the effect of this cooperation is small. The distance between the common aperture and the plate-shaped part is the distance in the z-direction (transverse to the plate-shaped part), measured at the area of the overlap between the edge around the common aperture and the outer apertures.

In a preferred embodiment, the outer apertures are separated from the tubular part ($0.3\ \text{mm} \leqq s_3$) at least by an edge of approximately 0.3 mm of the plate-shaped part. Edges thinner than approximately 0.3 mm can deform relatively easily in the manufacture of the plate-shaped part or during securing the plate-shaped part in the tubular part. This adversely affects the quality of the main lens.

In a preferred embodiment, the distance over which the outer apertures in the plate-shaped part extend beyond the folded edge is at least 5% of the diameter of the outer apertures, measured in the in-line plane ($s_2 \geqq 0.05\ d_2$).

In an example, $s_1$=19.6 mm, $d_1$=1.1 mm, $d_2$=6.53 mm and $s_2$=0.55 mm and $s_3$=0.5 mm ($d_1/s_2$=2, $s_2$=0.075 $d_2$). The height of the edge typically ranges between 0.3 and 0.7 mm.

The plate-shaped part preferably comprises several projections 25*g* by means of which said plate-shaped part is secured to the tubular part, for example by welding. Apart from said projections, there is further preferably a small interspace (for example approximately 0.1 mm) between the circumference of the plate-shaped part and the tubular part. This interspace reduces the risk that the plate-shaped part is obliquely welded in the tubular part and that, in operation, the plate-shaped part is subject to deformation as a result of a temperature increase of the electron gun.

Preferably, the plate-shaped and tubular parts of the first and second lens electrodes are equal in shape (i.e. in the present example the parts 25*a* and 26*a* are equal in shape as well as the parts 25*c* and 26*c*). This results in an improved reproducibility of the quality of the main lens. Apart from being identical in shape, the parts are preferably also arranged mirror symmetrically.

In an embodiment, the distance between the common aperture and the plate-shaped part is different for the lens electrodes. In the example, $d_1$ ($G_3$) is unequal to $d_1$ ($G_4$). By virtue thereof, the CHA and the beam displacement can both be kept down, even for a 0 pixel error.

In another embodiment, the distance between the common aperture and the plate-shaped part is the same for both lens electrodes. This leads to a reduction of the manufacturing differences between the lens electrodes and hence to an improved reproducibility of the quality of the main lens.

It will be obvious that within the scope of the invention many variations are possible to those skilled in the art.

In embodiments, the plate-shaped part may be, for example, a part of a tubular member which is arranged in the relevant lens electrode.

We claim:

1. A colour cathode ray tube comprising an in-line electron gun for generating three coplanar electron beams, said electron gun having a main lens portion comprising a first lens electrode and a second lens electrode, said first and second lens electrodes each having an aperture which is common to the three electron beams, which common aperture is bounded by an edge, and said lens electrodes each having a central aperture and two outer apertures for allowing passage of, respectively, the central and outer electron beams, said central and outer apertures being situated in a plate-shaped part which is arranged in the relevant lens electrode at some distance from and recessed with respect to the common aperture, said common apertures of the first and second lens electrodes facing each other, characterized in that in both the first and the second lens electrodes, the outer apertures in the plate-shaped part are formed such that, viewed in projection on the plate-shaped part and from the other lens electrode, the outer apertures extend in the in-line plane beyond the edge of the common aperture, said outer apertures being entirely enclosed in said plate-shaped part.

2. A colour cathode ray tube as claimed in claim 1, characterized in that the distance between the common aperture and the plate-shaped part is different for the first lens electrode and the second lens electrode.

3. A colour cathode ray tube as claimed in claim 1, characterized in that the distance between the common aperture and the plate-shaped part is the same for the first lens electrode and the second lens electrode.

4. A colour cathode ray tube as claimed in claim 1, characterized in that the ratio of the distance between the common aperture and the plate-shaped part to the distance over which the outer apertures in the plate-shaped part extend beyond the edge ranges between 0.5 and 5.

5. A colour cathode ray tube as claimed in claim 1, characterized in that the outer apertures are separated from an inner wall of the relevant lens electrode, at least, by an edge of approximately 0.3 mm of the plate-shaped part.

6. A colour cathode ray tube as claimed in claim 1, characterized in that the distance over which the outer apertures in the plate-shaped part extend beyond the edge of the common aperture is at least 5% of the diameter of the outer apertures, measured in the in-line plane.

7. A colour cathode ray tube as claimed in claim 1, characterized in that the plate-shaped part has several projections by means of which said plate-shaped part is secured to an inner wall of the relevant lens electrode.

8. A colour cathode ray tube as claimed in claim 7, characterized in that there is a small interspace between the circumference of the plate-shaped part and the inner wall.

9. A colour cathode ray tube comprising an in-line electron gun for generating three coplanar electron beams, said electron gun having a main lens portion comprising a first lens electrode and a second lens electrode, said first and second lens electrodes each having an aperture which is common to the three electron beams and which is bounded by an edge, and said lens electrodes each having a central aperture and two outer apertures for allowing passage of, respectively, the central and outer electron beams, said central and outer apertures being situated in a plate-shaped part which is arranged in the relevant lens electrode at some distance from and recessed with respect to the common aperture, said common apertures of the first and second lens electrodes facing each other, characterized in that at least one of the lens electrodes has a tubular part in which the common aperture is formed, and in that the plate-shaped part is situated inside th tubular part, and the outer apertures are separated from the inside of the tubular part by an edge of the plate-shaped part.

* * * * *